US006935887B2

(12) United States Patent
Endo

(10) Patent No.: US 6,935,887 B2
(45) Date of Patent: Aug. 30, 2005

(54) CONNECTOR PREVENTIVE OF INCOMPLETE FITTING

(75) Inventor: Tomomi Endo, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/750,875

(22) Filed: Jan. 5, 2004

(65) Prior Publication Data

US 2004/0142594 A1 Jul. 22, 2004

(30) Foreign Application Priority Data

Jan. 16, 2003 (JP) ..... P2003-008329

(51) Int. Cl.[7] ..... H01R 13/62

(52) U.S. Cl. ..... 439/489; 439/595; 439/352; 439/752

(58) Field of Search ..... 439/489, 352–358, 439/474, 595, 752

(56) References Cited

U.S. PATENT DOCUMENTS 6,491,542 B1 * 12/2002 Zerebilov ..... 439/489
6,638,108 B2 * 10/2003 Tachi ..... 439/595

FOREIGN PATENT DOCUMENTS

EP 0 227 288 A3 7/1987
EP 0 418 790 A1 3/1991
GB 2 368 731 A 5/2002
GB 2 376 814 A 12/2002
JP 11-67348 A 3/1999

* cited by examiner

*Primary Examiner*—Truc Nguyen
(74) *Attorney, Agent, or Firm*—Sughrue Mion, PLLC

(57) ABSTRACT

A first connector housing has a first flexible arm member formed with a hole. A second connector housing has a projection adapted to be engaged with the hole in a case where the second connector housing is fitted with the first connector housing in a first direction. A fitting detection member is attached with the first connector housing such that the first connector housing is movable in the first direction between a first position and a second position. The fitting detection member has a second flexible arm member adapted to be engaged with the first flexible arm member to retain the first connector housing at the first position. The engagement between the first flexible arm member and the second flexible arm member is released to allow the first connector housing to move to the second position, in a case where the first flexible arm member is flexed when the first connector housing is placed at the first position. The engagement between the projection and the hole is released only in a case where the first flexible arm member is flexed when the first connector housing is placed at the second position.

2 Claims, 9 Drawing Sheets

CONNECTOR PREVENTIVE OF INCOMPLETE FITTING

BACKGROUND OF THE INVENTION

The present invention relates to a connector for detecting an incomplete fitting state when male and female connector housings are fitted to each other.

Japanese Patent Publication No. 11-67348A discloses a connector preventive of incomplete fitting as shown in FIG. 9. In male and female connector housings 60 and 70 constituting a connector, the male connector housing 60 is attached to a door panel in a standby state that the male connector housing 60 is projected via a holder 81 made of a synthetic resin. The female connector housing 70 is detachably fitted with the male connector housing 60 at the standby state.

The holder 81 is constituted by a cylindrical member 82 formed substantially in a shape of a quadrangular cylinder by upper and lower walls 82*a* and 82*b* and left and right side walls 82*c* and 82*d*, and a bracket 83 formed by being integrally projected from a side of the lower wall 82*b* of the cylindrical member 82.

A pair of slits 84 are formed at a center of each of the left and right side walls 82*c* and 82*d*, and an L-shaped flexible arm 85 is formed by being integrally projected from between each pair of slits 84. A projection 86 having a trapezoidal cross section is formed by being integrally projected from an inner side of a front end of each of the pair of flexible arms 85 and a slope face is formed at a portion rearward from each of the projections 86.

A pair of stoppers 87 for restricting a frontward projection amount of the male connector housing 60 are formed by being integrally projected from centers on front edge sides of inner faces of the upper and the lower walls 82*a* and 82*b*.

Further, a clearance is provided over an entire periphery between the cylindrical member 82 of the holder 81, and a hood 61 of the male connector housing 60, such that the male connector housing 60 is slidably supported at the inside of the cylindrical member 82. That is, when the fitting of the male connector housing 60 and the female connector housing 70 is completed, these connector housings 60 and 70 are slid toward the door panel (the bracket 83 ) at the inside of the holder 81.

The male connector housing 60 is constituted by: a housing 62 having a plurality of chambers 62*a* for containing female terminals; and the hood 61 covering the housing 62. A base portion of the housing 62 is integrated to a base portion of the hood 61 by press-fitting or the like in an aligned state. The hood 61 is formed substantially in a shape of a quadrangular cylinder by side walls to serve as a guide for the holder 81 and the female connector housing 70.

A pair of slits are formed at centers of the left and right side walls of the hood 61 and a flexible retaining piece 68 is integrally formed in each of the pair of slits. Each flexible retaining piece 68 has a hole 67 to which the projection 86 of each flexible arm 85 of the holder 81 is detachably engaged. A width of each flexible retaining piece 68 is set to be larger than a width of the projection 86 so that the respective flexible retaining pieces 68 are made to be contactable to the side walls 82*c* and 82*d* at vicinities of the respective flexible arms 85.

When the projections 86 of the respective flexible arms 85 are engaged with the holes 67 of the respective flexible retaining pieces 68, the male connector housing 60 is projected from the holder 81 by a predetermined length as a standby state for fitting with the female connector housing 70. That is, by engaging the projections 86 with the holes 67, the retract movement of the male connector housing 60 relative to the holder 81 is restricted, so that the standby position becomes a position for the fitting or detaching operation of the male and female connector housings 60 and 70.

The female connector housing 70 is a block-shaped member in which a rear side of a base portion 71 is formed with a plurality of chambers 71*a* for containing male terminals, and a front side thereof is formed by being integrally projected from the base portion 71 to constitute a hood portion 72 in a shape of a quadrangular cylinder exposing the respective male terminals. The hood portion 72 of the female connector housing 70 is inserted between the housing 62 and the hood 61 of the male connector housing 60 in fitting the male and female connector housings 60 and 70 to thereby electrically connect the respective terminals of the male and female connector housings 60 and 70.

At a front center portion of each outer side face of the hood portion 72, a projection 73 is integrally formed so as to have a triangular cylinder shape such that a front side and a rear side are formed as slope faces 73*a* and 73*b*, respectively.

In such a configuration, the standby state of the male connector housing 60 is maintained by the engagement between the projections 86 of the flexible arms 85 in the holder 81 and the holes 67 of the retaining pieces 68 in the male connector, as an initial state of the fitting operation. During the fitting operation of the connector housings 60 and 70, the projections 73 of the female connector housing 70 urge the retaining pieces 68 of the male terminal 60 so as to elastically deform outward, thereby securing the engagement between the projections 86 and the holes 67.

When the female connector housing 70 is completely fitted with the male connector housing 60, the projections 73 enter into the holes 67 to release the engagement between the projections 86 and holes 67. After then, the integrated connector housings 60 and 70 slide downward at the inside of the holder 81 to complete an attaching operation of a switch unit onto the door panel.

However, in the above configuration, when the connector housings 60 and 70 are disengaged by disengaging the projections 73 of the female connector housing 70 from the holes 67 of the male connector housing 60, the male connector housing 60 is not always duly returned to the standby position thereof. That is, in a case where the connector housings 60 and 70 are subjected to a refitting operation, the standby state of the male connector housing 60 is not assured. Accordingly, an operator has to place the male connector housing 60 at the standby position, so that workability becomes worse.

SUMMARY OF THE INVENTION

It is therefore an object of the invention to provide a connector preventive of incomplete fitting, in which a pre-fitting state is assured when connector housings are subjected to a refitting operation in order to promote the workability.

In order to achieve the above object, according to the invention, there is provided a connector, comprising:

a first connector housing, comprising a first flexible arm member formed with a hole;

a second connector housing, comprising a projection adapted to be engaged with the hole in a case where the second connector housing is fitted with the first connector housing in a first direction; and a fitting detection member, attached with the first connector housing such that the first connector housing is movable in the first direction between a first position and a second position, the fitting detection member comprising a second flexible arm member adapted to be engaged with the first flexible arm member to retain the first connector housing at the first position, wherein:

the engagement between the first flexible arm member and the second flexible arm member is released to allow the first connector housing to move to the second position, in a case where the first flexible arm member is flexed when the first connector housing is placed at the first position; and the engagement between the projection and the hole is released only in a case where the first flexible arm member is flexed when the first connector housing is placed at the second position.

In such a configuration, the engagement between the first connector housing and the fitting detection member is released by flexing the first flexible arm member, in a case where the first connector housing is placed at the first position. The engagement between the first connector housing and the second connector housing is released by flexing the first flexible arm member, only in a case where the first connector housing is placed at the second position.

Therefore, when the first connector housing and the second connector housing are subjected to a refitting operation, the first connector housing is always placed at the second, standby position. Since the additional operation for placing the first connector housing at the standby position, the workability can be promoted.

Here, it is preferable that: a rib member is provided on the fitting detection member and adapted to be abutted against the first flexible arm member to restrict a flexible amount of the first flexible arm member such an extent that only the engagement between the first flexible arm member and the second flexible arm member, in a case where the first connector housing is placed at the first position; and the first flexible arm member is formed with a recess adapted to receive the rib member to enlarge the flexible amount of the first flexible member only in a case where the first connector housing is placed at the second position.

In such a configuration, the engagement between the first connector housing and the second connector housing cannot be released.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Figure 1:
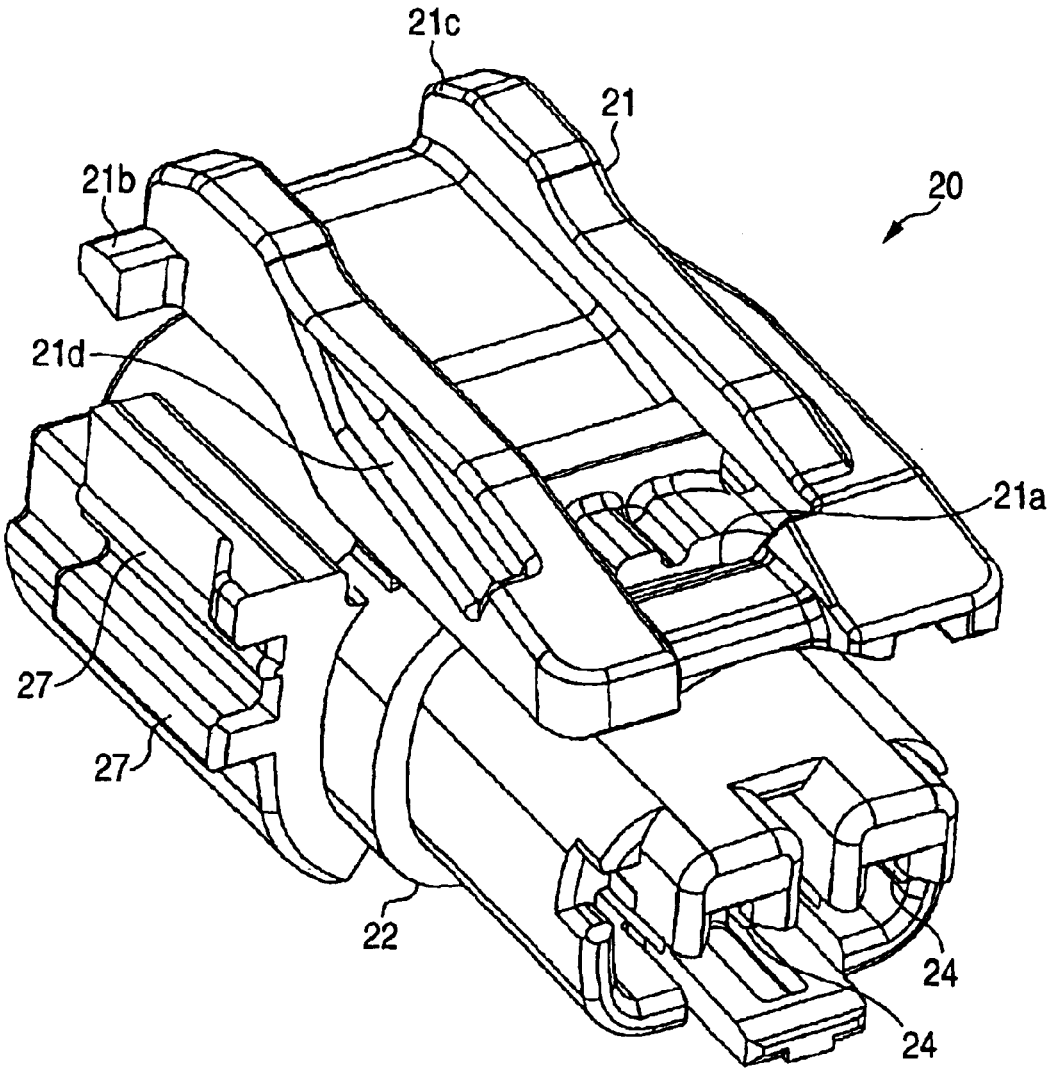
FIG. 1 is a perspective view of a female connector housing in a connector according to one embodiment of the invention.

One preferred embodiment of the invention will be described below in detail with reference to the accompanying drawings.

A connector 10 according to the invention is constituted by a female connector housing 20 having a flexible lock arm 21, a fitting detection member 30 having a flexible locking arm 31, and a male connector housing 40 having a lock beak 41 is fitted. The male connector housing 40 is fitted between the female connector housing 20 and the fitting detection member 30.

Figure 4:
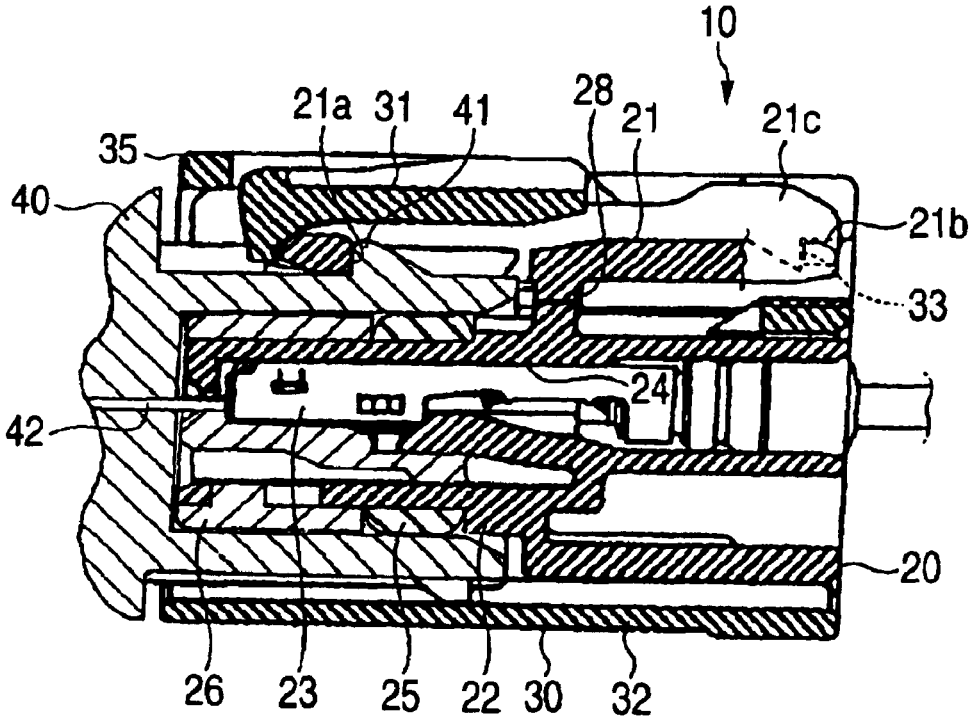
FIG. 4 is a sectional view of the connector showing a state that the female connector housing is completely fitted with a male connector housing.

As shown in FIG. 1 and FIG. 4, the female connector housing 20 is provided with a cylindrical main body 22 formed with chambers 24 for holding a pair of female terminals 23. The main body 22 is mounted with a front holder 26 from a front side via an O ring 25. Two pairs of guide projections 27 are projected from side portions of the main body 22.

The flexible lock arm 21 is arranged at an upper face of the main body 22 and extended to frontward and rearward directions from an upper end of a stay portion 28 along a fitting direction of the main body 22. The stay portion 28 is erected substantially at a center of the upper face of the main body 22 so that the flexible lock arm 21 is capable of being displaced in a seesaw manner with the stay portion 28 as a fulcrum.

A locking hole 21*a* is formed on a front end side in the fitting direction of the flexible lock arm 21. When the female connector housing 20 is disposed at an initial fitting position (i.e., the claimed second position), the flexible locking arm 31 provided at the fitting detection member 30 is fitted into the locking hole 21*a* from above. Further, when the female connector housing 20 is disposed at a complete fitting position (i.e., the claimed first position), the lock beak 41 of the male connector housing 40 is fitted into the locking hole 21*a* from below.

Figure 2:
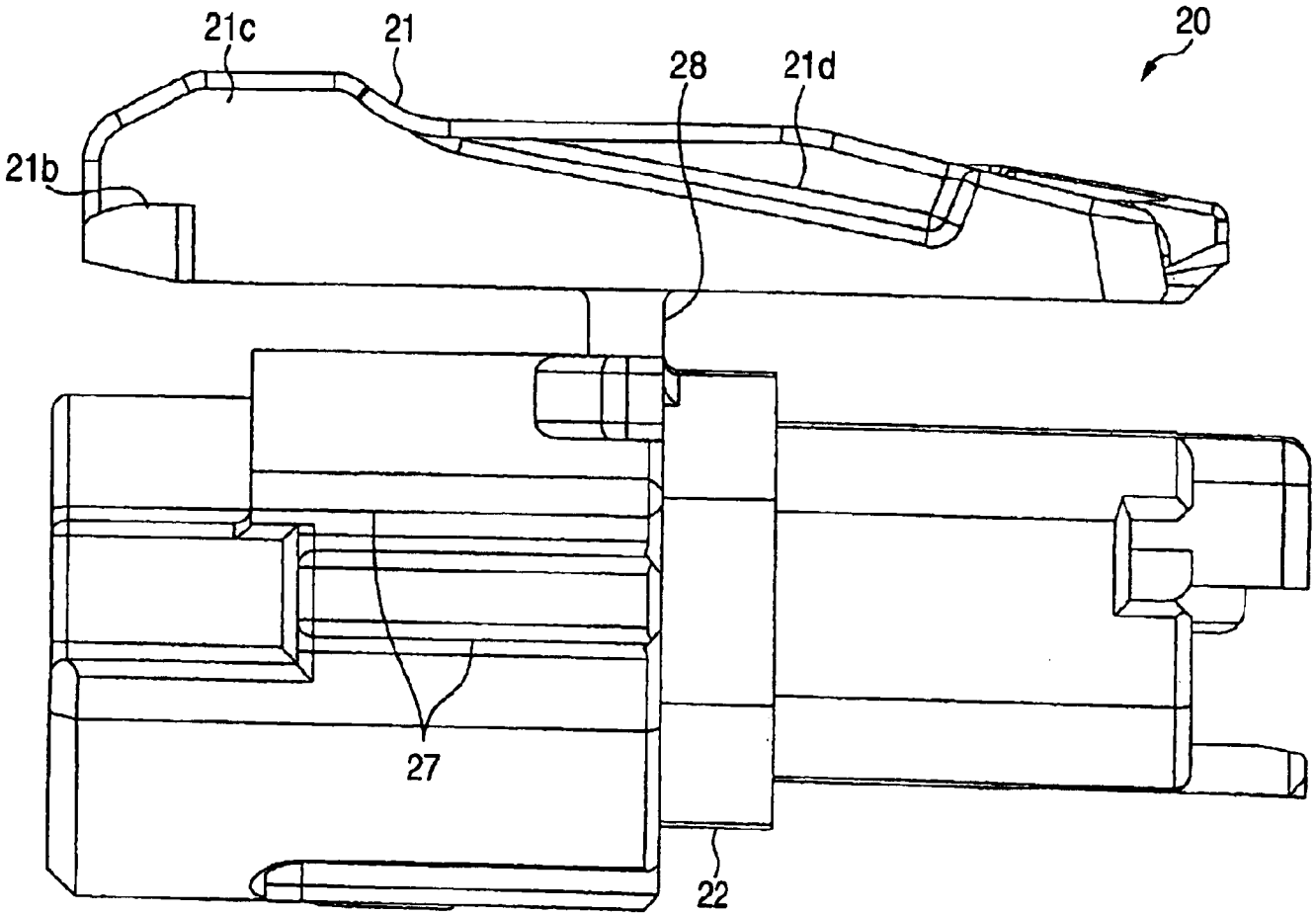
FIG. 2 is a side view of the female connector housing.

As shown in FIG. 2, a pair of projections 21*b* are formed on a rear end side of the fitting direction of the flexible lock arm 21. The projections 21*b* are configured to engage with a pair of engaging portions 33 formed at the fitting detection member 30 (described later) when the female connector housing 20 is disposed at the complete fitting position with respect to the male connector housing 40. In this condition, the slide movement of the female connector housing 20 is restricted to maintain the complete fitting state.

On the other hand, the projections 21*b* are disengaged from the engaging portions 33 when an operation member 21*c* arranged on a side opposed to the locking hole 21*a* of the flexible lock arm 21 is pressed downward in a case where the female connector housing 20 is disposed at the complete fitting position. In this condition, the slide movement of the female connector housing 20 is allowed to cancel the complete fitting state.

As shown in FIG. 2, a pair of recessed portions 21*d* are formed at side portions of the flexible lock arms 21. The recessed portions 21*d* are provided to disengage the lock beak 41 of the connector housing 40 from the locking hole 21*a* while increasing a flexed amount of the flexible lock arms 21 by receiving ribs 36 formed at the fitting detection member 30. When the operation member 21*c* of the flexible lock arm 21 is pressed downward in a case where the female connector housing 20 is disposed at the initial position (provisional fitting state), the lock beak 41 is disengaged from the locking hole 21*a* with the assist of the recessed portions 21*d*.

The recessed portions 21*d* are arranged so as to face the ribs 36 of the fitting detection member 30 only when the female connector housing 20 is disposed at the initial position. When the female connector housing 20 is disposed at the complete fitting position, the recessed portions 21*d* are not faced the ribs 36. Therefore, even when the operation member 21*c* of the flexible lock arms 21 are pressed downward at the complete fitting position of the female connector housing 20, an upper face of the flexible lock arm 21 other than the recessed portions 21*d* impinge on the ribs 36.

Thereby, the flexed amount the flexible lock arm 21 is restricted to be small so that the lock beak 41 of the male connector housing 40 cannot be disengaged from the locking hole 21*a*.

Figure 3:
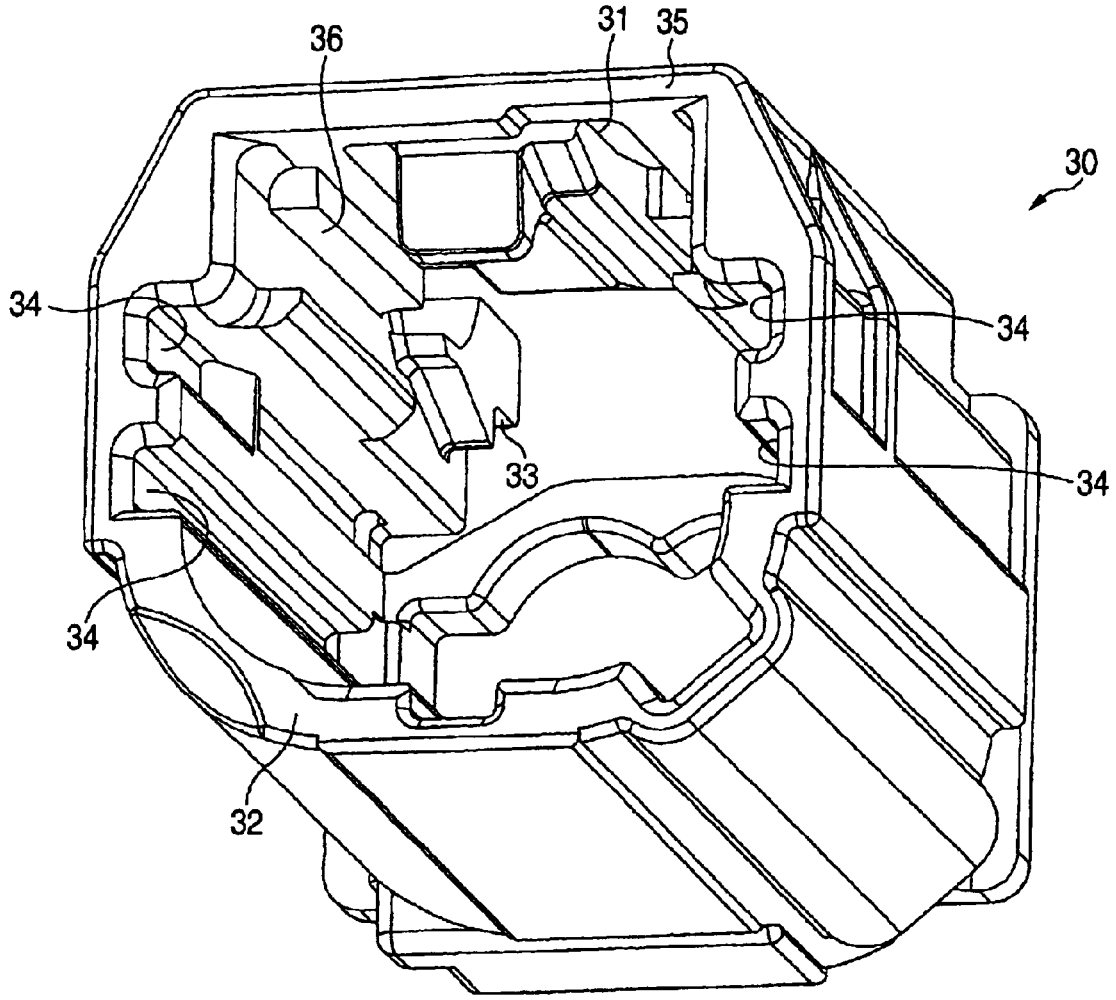
FIG. 3 is a perspective view of a fitting detection member in the connector.

As shown in FIG. 3, the fitting detection member 30 is provided with a cylindrical main body 32 configured to be fitted to an outer periphery of the female connector housing 20 to cover the main body 22. The pair of engaging portions 33 are formed at a rear end portion of the main body 32.

An inner peripheral face of the main body 32 is formed with guide grooves 34 in correspondence with the guide projections 27 of the female connector housing 20. The guide grooves 34 are inserted with the guide projections 27 so that the relative sliding movement between the female connector housing 20 and the fitting detection member 30 is smoothly carried out without a positional shift therebetween.

The flexible locking arm 31 is arranged at a ceiling portion 35 of the main body 32 so as to be flexible in up and down directions of FIG. 3. An inner peripheral portion of the ceiling portion 35 is formed with the pair of ribs 36.

The ribs 36 restrict the flexed amount of the flexible lock arms 21 to be small when the female connector housing 20 is disposed at the complete fitting position. To the contrary, the ribs 36 are received by the recessed portions 21*d* of the flexible lock arm 21 when the female connector housing 20 is disposed at the initial position, to considerably enlarge the flexed amount of the flexible lock arm 21.

Next, an explanation will be given of movement of respective portions when operation of releasing fitting is carried out from a fitting state of the connector 10 with reference to FIG. 4 through FIG. 8.

As shown in FIG. 4, in the state of fitting the male and female connector housings 20 and 40, the female connector housing 20 is disposed at the complete fitting position, the lock beak 41 of the male connector housing 40 is fitted into the locking hole 21*a* of the flexible lock arm 21, and the flexible locking arm 31 of the fitting detection member 30 is locked by a front end portion of the flexible lock arm 21.

Further, by engaging the projections 21*b* of the female connector housing 20 with the engaging portions 33 of the fitting detection member 30, the female connector housing 20 is held at the complete fitting position. The male terminals 42 contained in the male connector housing 40 are electrically connected to the female terminals 23 at the inside of the female connector housing 20.

Figure 5:
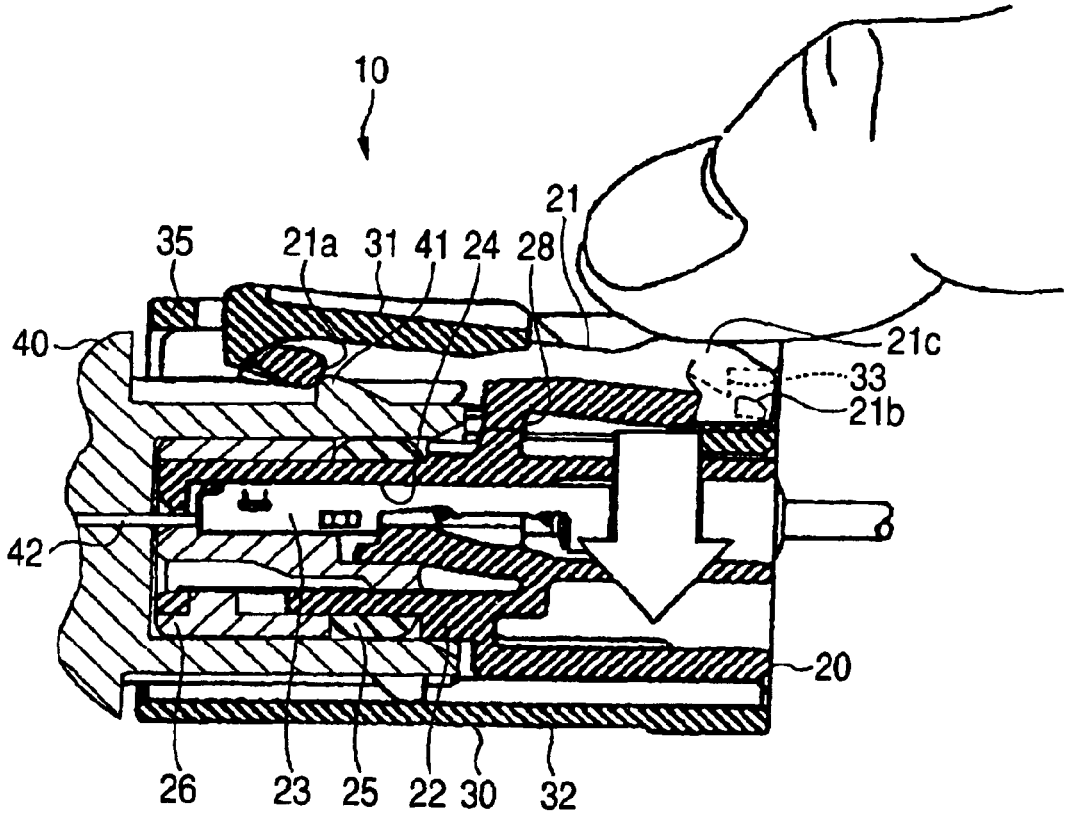
FIG. 5 is a sectional view of the connector showing a state that a flexible lock arm of the female connector housing is actuated in the state shown in FIG. 4.

As shown in FIG. 5, in a state where the female connector housing 20 is disposed at the complete fitting position, when the operation member 21*c* of the flexible lock arms 21 is pressed downward, the flexible lock arm 21 is flexed and the projections 21*b* are disengaged from the engaging portions 33. At this occasion, the flexible locking arm 31 is detached from the outer end portion of the flexible lock arm 21 so that the engagement between the female connector housing 20 and the fitting detection member 30 is released.

However, since the recessed portions 21*d* are not facing the ribs 36 of the fitting detection member 30, upper faces of the flexible lock arm 21 impinge at the ribs 36, the flexed amount of the flexible lock arm 21 is restricted to be small so that the lock beak 41 of the male connector housing 40 cannot be disengaged from the locking holes 21*a*.

Figure 6:
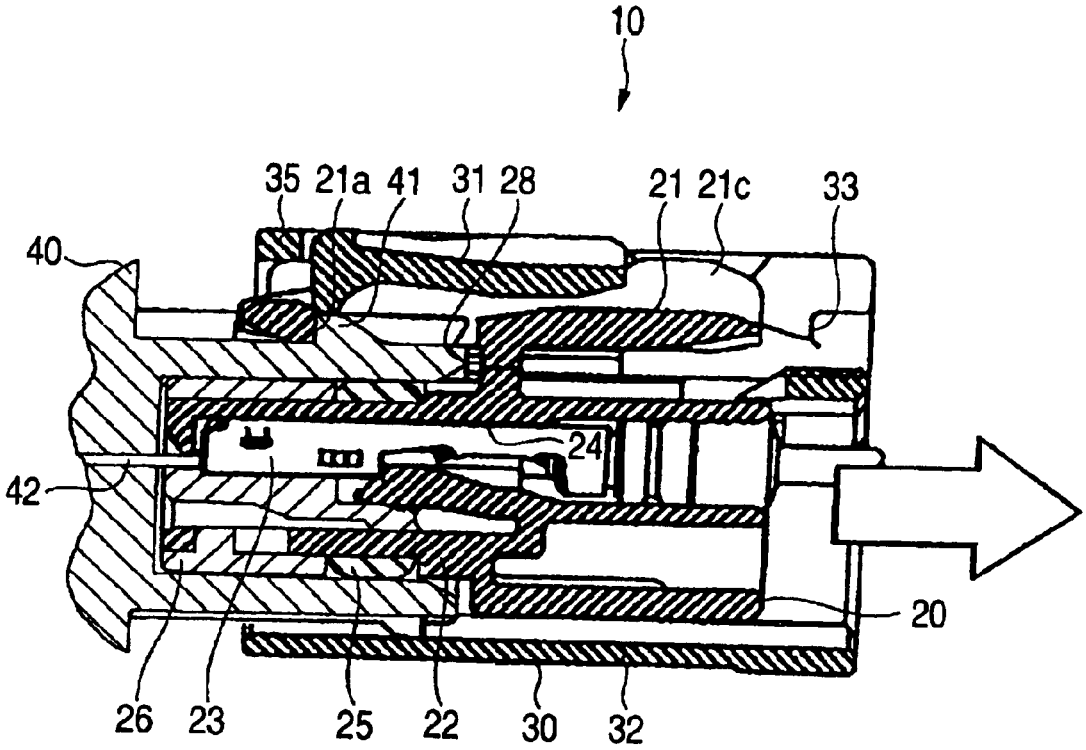
FIG. 6 is a sectional view of the connector showing a state that the female connector housing is provisionally fitted with the male connector housing.

As shown in FIG. 6, by pressing the flexible lock arm 21, the projections 21*b* are disengaged from the engaging portions 33 while the lock beaks 41 of the male connector housing 40 are not disengaged from the locking holes 21*a*. At this occasion, the flexible locking arm 31 is disengaged from the front end portion of the flexible lock arm 21 so that the fitting detection member 30 is slid to the right direction of FIG. 6 and the female connector housing 20 is set to the initial position at which the front holder 25 is projected from the front end portion of the fitting detection member 30.

Figure 7:
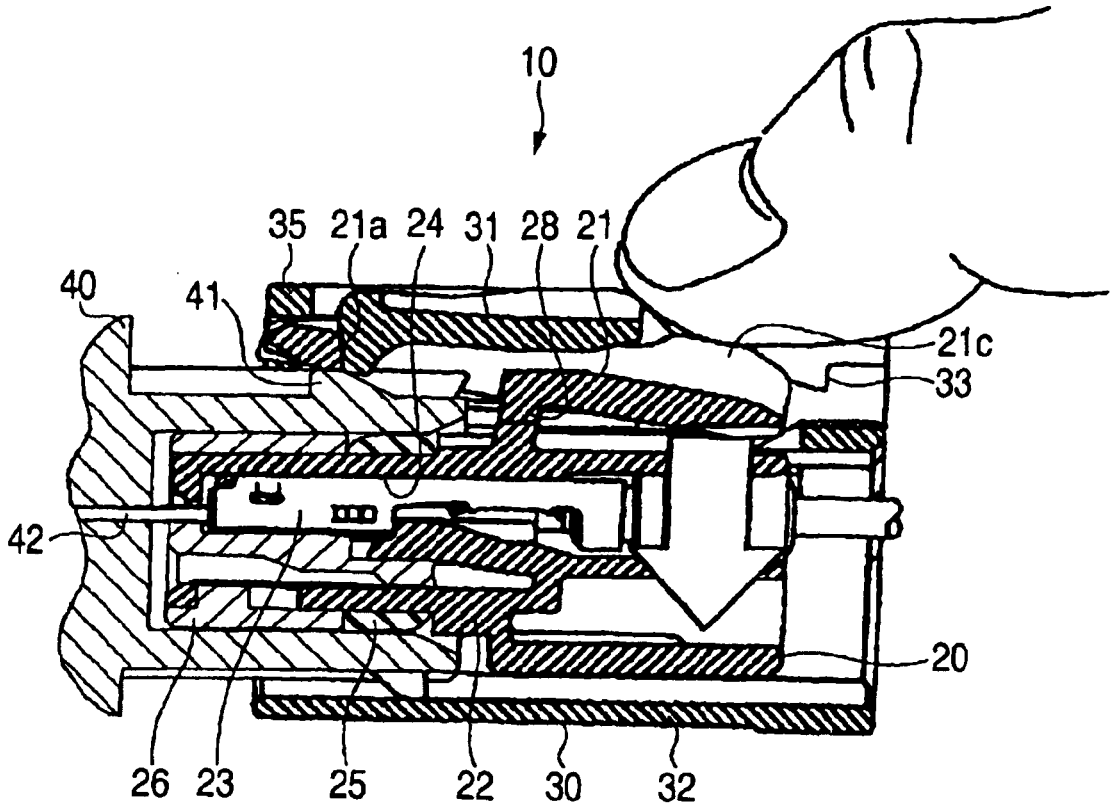
FIG. 7 is a sectional view of the connector showing a state that the flexible lock arm is actuated in the state shown in FIG. 6.

As shown in FIG. 7, when the female connector housing 20 is set to the initial position while the lock beak 41 is not disengaged from the locking hole 21*a*, the operation member 21*c* of the flexible lock arm 21 is pressed again. At this occasion, since the recessed portions 21*d* of the flexible lock arms 21 are facing the ribs 36 of the fitting detection member 30, the ribs 36 are contained in the recessed portions 21*d*.

Thereby, the flexed amount the flexible lock arm 21 is considerably enlarged so that the lock beak 41 is disengaged from the locking hole 21*a*.

Figure 8:
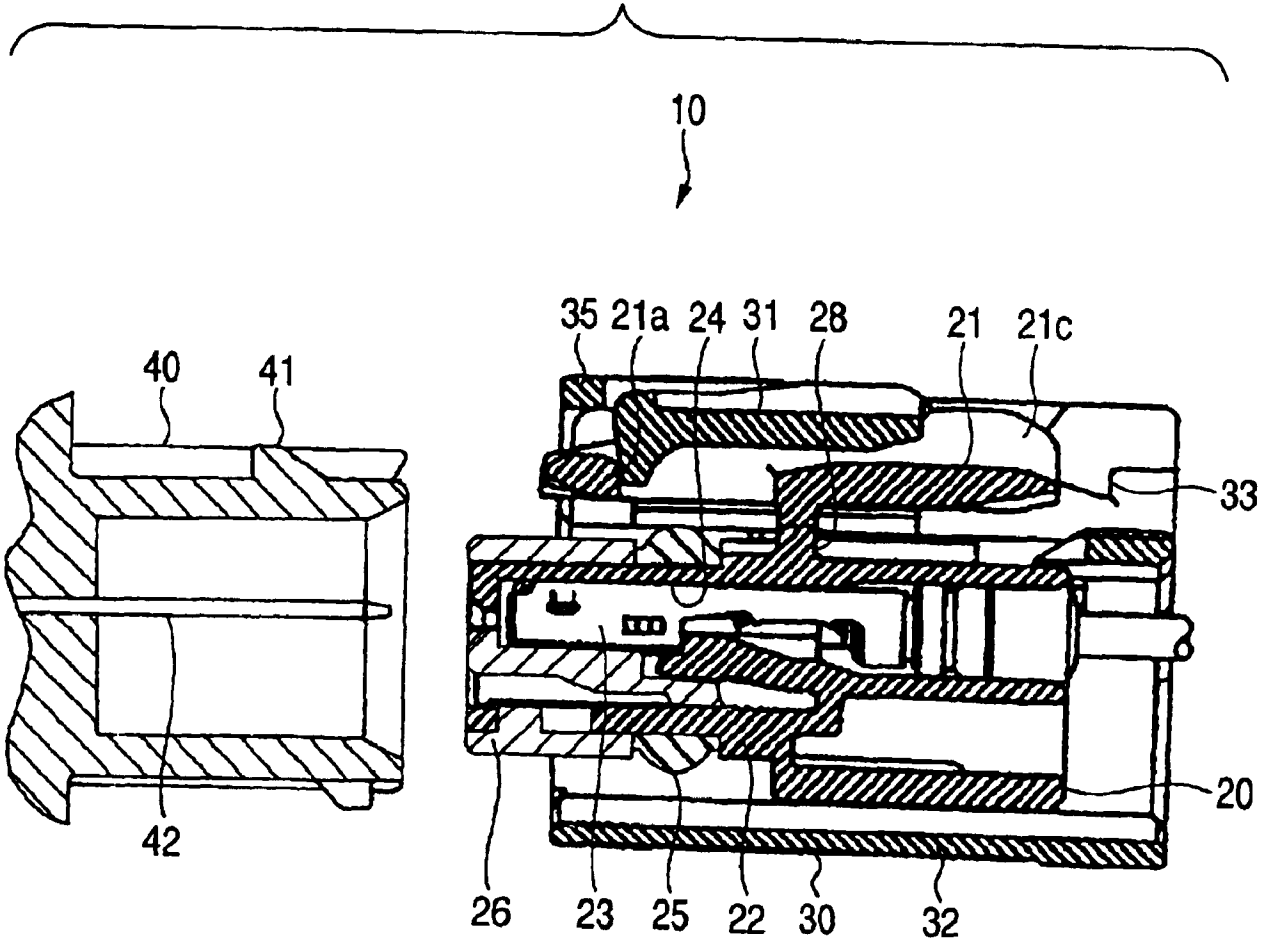
FIG. 8 is a sectional view of the connector showing a state that the female connector housing is disengaged from the male connector housing.
Figure 9:
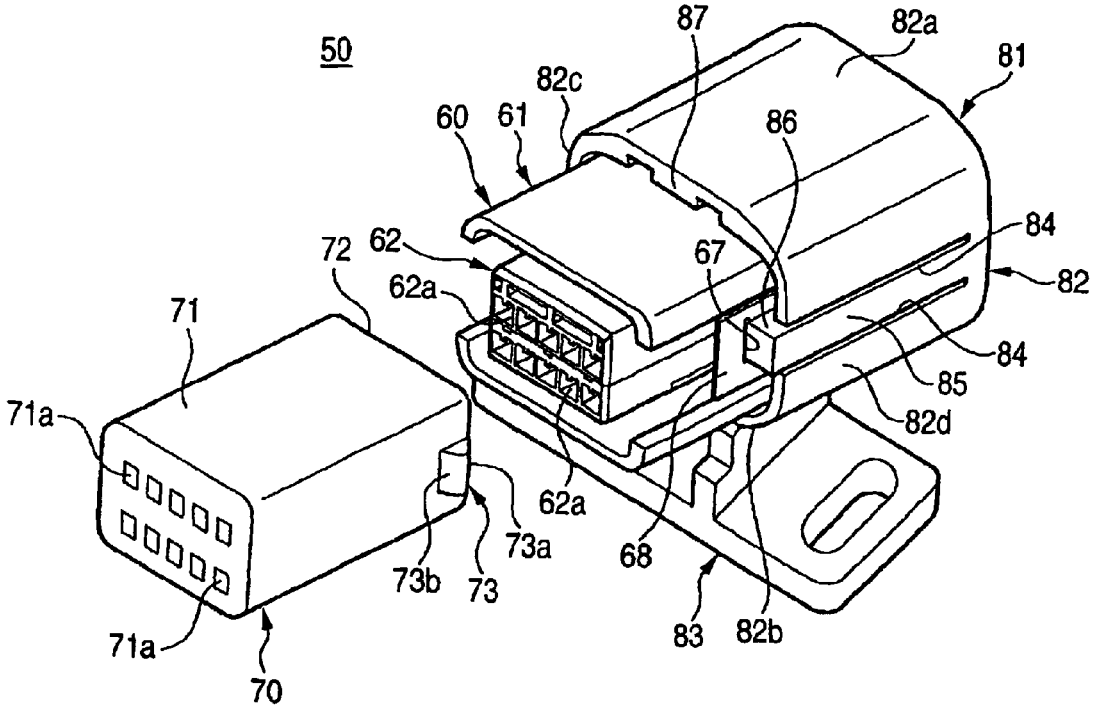
PRIOR ART FIG. 9
FIG. 9 is a sectional view of a related-art connector preventive of incomplete fitting.

As shown in FIG. 8, after setting the female connector housing 20 to the initial position, by pressing the operation member 21*c* of the flexible lock arm 21 again, the lock beak 41 is disengaged from the locking hole 21*a* to release the fitting. The male terminals 42 of the male connector housing 40 and the female terminals 23 of the female connector housing 20 are electrically disconnected from each other.

As described above, according to the embodiment, the male connector housing 40 cannot be released unless the female connector housing 20 disposed at the complete fitting position is temporarily recovered to the initial position.

Further, since the female connector housing 20 can firmly be recovered to the initial position when the flexible lock arm 21 is pressed once, it is not necessary to carry out fitting operation by optical observation of the operator and it is not also necessary to carry out additional operation of firmly returning the female connector housing 20 to the initial fitting position by the operator.

According to the embodiment, in a case where the female connector housing 20 is disposed at the complete fitting position and the flexible lock arms 21 are flexed, the projections 21*b* of the female connector housing 20 are disengaged from the engaging portions 33 of the fitting detection member 30. Thereby, the female connector housing 20 is permitted to move to the initial fitting position, however, since the flexed amount the flexible lock arms 21 is restricted to be small by the ribs 36 of the fitting detection member 30, the male connector housing 40 cannot be released from being locked.

At this occasion, by flexing again the flexible lock arms 21 relative to the female connector housing 20 disposed at the initial fitting position, the flexed amount of the flexible lock arms 21 is enlarged by the recessed portions 21*d* receiving the ribs 36. Thereby, the lock beak 41 of the male connector housing 40 is released from the flexible lock arm 21 to thereby cancel the fitting.

Therefore, since the female connector housing 20 can firmly be returned to the initial fitting position from the complete fitting position, the initial position of the female connector housing 20 is guaranteed upon the refitting operation.

Further, since the operator does not need to manually move the female connector housing 20 to the initial fitting position, the workability in the refitting operation can be promoted.

Further, the connector according to the invention is not limited to the above-described embodiment but can pertinently be modified or improved. For example, numbers and arrangement of the female terminals and the male terminals are not limited to single pairs. Plural pairs of the terminals may be provided.

Further, the shape of the ribs 36 is not limited to one as illustrated, but the rib may be constituted such that an outer face thereof is curved or tapered adequately. Further, the shape of the recessed portion is not limited to one as illustrated, but may preferably be formed in correspondence with the shape of the rib.

What is claimed is:

1. A connector, comprising:

a first connector housing, comprising a first flexible arm member formed with a hole;

a second connector housing, comprising a projection adapted to be engaged with the hole in a case where the second connector housing is fitted with the first connector housing; and a fitting detection member, attached with the first connector housing such that the first connector housing is movable between a first position and a second position, the fitting detection member comprising a second flexible arm member adapted to be engaged with the first flexible arm member to retain the first connector housing in the first position, wherein:

the engagement between the first flexible arm member and the second flexible arm member is released to allow the first connector housing to move from the first position to the second position, in a case where the first flexible arm member is flexed when the first connector housing is in the first position; and the engagement between the projection and the hole is released only when the first flexible arm member is again flexed when the first connector housing is in the second position.

2. The connector as set forth in claim 1, wherein:

a rib member is provided on the fitting detection member and adapted to be abutted against the first flexible arm member when the first connector housing is in the first position, the rib member restricts a flex amount of the first flexible arm member; and the first flexible arm member is formed with a recess adapted to receive the rib member to enlarge the flex amount of the first flexible member only when the first connector housing is in the second position.

* * * * *